US011024238B2

(12) United States Patent
Zha

(10) Patent No.: US 11,024,238 B2
(45) Date of Patent: Jun. 1, 2021

(54) HIGH DYNAMIC CONTRAST IMAGE DISPLAY METHOD AND DEVICE BASED ON PARTITIONED BACKLIGHT

(71) Applicant: Wuhan China Star Optoelectronics Technology Co., Ltd., Hubei (CN)

(72) Inventor: Guowei Zha, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 512 days.

(21) Appl. No.: 16/068,879

(22) PCT Filed: Apr. 20, 2018

(86) PCT No.: PCT/CN2018/083922
§ 371 (c)(1),
(2) Date: Jul. 9, 2018

(87) PCT Pub. No.: WO2019/148667
PCT Pub. Date: Aug. 8, 2019

(65) Prior Publication Data

US 2021/0082355 A1 Mar. 18, 2021

(30) Foreign Application Priority Data

Jan. 30, 2018 (CN) ..... 201810089729.9

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/062* (2013.01);
(Continued)

(58) Field of Classification Search
CPC .... G09G 3/3426; G09G 3/36; G09G 2360/16; G09G 2320/062; G09G 2320/066; G09G 2320/0646
See application file for complete search history.

(56) References Cited

U.S. PATENT DOCUMENTS

2018/0090076 A1* 3/2018 Zhang ..... G09G 3/3426
2019/0005630 A1* 1/2019 Li ..... G09G 3/3426
2020/0342819 A1* 10/2020 Cheng ..... G09G 3/342

* cited by examiner

*Primary Examiner* — Rodney Amadiz
(74) *Attorney, Agent, or Firm* — Leong C. Lei

(57) ABSTRACT

A high dynamic contrast image display method and device based on a partitioned backlight is disclosed. The method includes steps of: S1: obtaining a brightness information of an arbitrary pixel of an image, S2: obtaining a low-frequency illumination signal of the arbitrary pixel by gaussian filtering, S3: according to a space division of a partitioned backlight, diving the low-frequency illumination signals as same M*N partitions, S4: for anyone of the M*N partitions, calculating a maximum value of the low-frequency illumination signals of a current partition, and S5: performing a linear compression to the low-frequency illumination signal in the current partition. In the invention, the low-frequency illumination signals are subjected to a linear compression according to the luminance range that covered by the actual backlight. Contrast spatial adaptation can be performed within the backlight brightness range, while spatial details corresponding to high-frequency reflected signals are reserved.

14 Claims, 3 Drawing Sheets

(52) U.S. Cl.
CPC ..... *G09G 2320/066* (2013.01); *G09G 2320/0646* (2013.01); *G09G 2360/16* (2013.01)

HIGH DYNAMIC CONTRAST IMAGE DISPLAY METHOD AND DEVICE BASED ON PARTITIONED BACKLIGHT

RELATED APPLICATIONS

The present application is a National Phase of International Application Number PCT/CN2018/083922, filed Apr. 20, 2018, and claims the priority of China Application No. 201810089729.9, filed Jan. 30, 2018.

FIELD OF THE INVENTION

The present invention relates to an image processing technology field, and more particularly to a high dynamic contrast image display method and device based on a partitioned backlight.

BACKGROUND OF THE INVENTION

The core of display technology is to reproduce the visual cognition of human eyes for nature. Currently, the mainstream display technology includes LCD (Liquid Crystal Display) and OLED (Organic Light-Emitting Diode, OLED). Wherein, the LCD technology has obvious advantages in cost and reliability, and the OLED technology still faces problems such as high cost and limited life as a late starting technology. However, with the progress of technology and improvement of the supply chain, the OLED technology has gradually drawn closer to the LCD technology, while having the advantages of high color gamut and high contrast at the same time. Meanwhile, the LCD technology is constantly being improved to cope with the competition of OLED technology. The adoption of RG phosphors and quantum dot technology makes LCD technology also have high color gamut characteristics. However, the lack of LCD dark state makes the contrast of the LCD to be unable to face the technical advantage of self-luminescence of the OLED technology, the main counterrmeasure in the current market is to use a dynamic partitioned backlight.

The adoption of the dynamic partitioned backlight enables the backlight of different partitions to independently adjust the brightness of the partition backlight according to the content of the current display screen, which has the purpose of improving the contrast and saving power consumption. At present, the backlight technology of the liquid crystal display mainly includes two types of direct-light type or side-light type. As shown in FIG. 1, the side-light type display device includes an LED 10, a light guide plate 20, a lower polarizer 30, a substrate 40, a liquid crystal layer 50, a CF substrate 60, and an upper polarizer 70. The side-light backlight module requires using a light guide plate (LGP), and the direct-light type backlight module is mainly achieved by different partitions of LED brightness and darkness in order to realize dynamic backlight function. Hardware preparation and dynamic control algorithms are indispensable, a good driving method can achieve the maximum degree of the unity of the image content and backlight control.

However, compared to the self-illuminating OLEO, the number of the partitions of LCD cannot reach a pixel-level, and only limited partitions are possible. In terms of spatial resolution, the LCD pixels provide images having a high spatial resolution, while partitioned backlights provide an image having a low spatial resolution. In addition, in terms of luminance contrast, the liquid crystal panel has a relatively small and fixed contrast. For the IPS mode, the contrast is usually 1000:1 to 1500:1, and the contrast ratio provided by the partitioned backlight is relatively large, from pure black to higher maximum brightness. How to achieve a low spatial resolution partitioned backlight and high spatial resolution TCD panel to match and drive with appropriate methods to achieve high-contrast display and fine detail is one of the core issues to be solved with a partitioned backlight LCD panel.

Therefore, for the above technology problems, a high dynamic contrast image display method and device based on a partitioned backlight is necessary.

SUMMARY OF THE INVENTION

To overcome the deficiencies of existing technologies, the purpose of the present invention is to provide a high dynamic contrast image display method and device based on a partitioned backlight.

To achieve the foregoing objective, the technical solution provided by an embodiment of the present invention is as follows:

A high dynamic contrast image display method based on a partitioned backlight, and the method comprises steps of: S1: obtaining a brightness information Lin(x, y) of an arbitrary pixel of an image; S2: obtaining a low-frequency illumination signal Lum (x, y) of the arbitrary pixel by gaussian filtering, and resolving the brightness information Lin(x, y) of the arbitrary pixel to be a product of a high frequency reflected signal R(x, y) and the low-frequency illumination signal Lum (x, y), that is Lin(x, y)=Lum(x, y)*R(x, y); S3: according to a space division of a partitioned backlight, diving the low-frequency illumination signals Lum (x, y) as same M*N partitions; S4: for anyone of the M*N partitions, calculating a maximum value $L_{mn}$max of the low-frequency illumination signals Lum (x, y) of a current partition, wherein inn indicates a partition located at a m-th in a horizontal direction and a n-th in a vertical direction; and S5: performing a linear compression to the low-frequency illumination signal in the current partition.

As a further improvement of the present invention, the step S2, "obtaining a low-frequency illumination signal Lum (x,y) of the pixel by gaussian filtering", is:

$$Lum(x, y) = \sum_{i \geq -I}^{i \leq I} \sum_{j \geq -J}^{j \leq J} f(x-i, y-j) * Lin(x, y),$$

wherein f(x, y) is a two-dimensional gaussian function, I and J are preset threshold values for calculating a spatial filtering of adjacent 4*I*J pixels of a current pixel (x, y).

As a further improvement of the present invention, the step S5, "performing a linear compression", is:

setting a backlight brightness coefficient of a partition (m, n) as $BLU_{mn}={}_{mn}\max/L_{max}*BLU_{man}$, wherein $L_{max}$ represents a maximum brightness that can be realized by the display panel, and $BLU_{max}$ represents a maximum backlight brightness among the partitions.

As a further improvement of the present invention, outputting a backlight brightness coefficient of each partition to a backlight brightness driving unit of each partition in order to light up of the backlight of each partition.

As a further improvement of the present invention, after the step S5, the method further comprises a step of: S6: for an arbitrary partition, calculating a luminance crosstalk among different partitions, calculating backlight brightness Blu (x, v) corresponding to pixels; and S7: calculating a brightness compensation signal $R_{new}(x,y)=Lin(x,y)/Blu(x, y)$, in order to obtain a new high frequency reflected signal.

As a further improvement of the present invention, the image in the step S1 is an image of a frame of a video, and an input signal of the video is a WV format.

As a further improvement of the present invention, the brightness information Lin(x, y) in the step S1 is obtained through extracting an information at Y channel.

A technology solution provided by another embodiment of the present invention is:

A high dynamic contrast image display device based on a partitioned backlight, the high dynamic contrast image display device includes multiple backlight units and backlight brightness driving units which are correspondingly one by one, the high dynamic contrast image display device displays an image through the above method.

In the invention, an image to be displayed is separated into high-frequency reflected signals and low-frequency illumination signals, which respectively correspond to high-frequency liquid crystal gray-scale and low-frequency partitioned backlight signals, wherein the low-frequency illumination signals are subjected to a linear compression according to the luminance range that covered by the actual backlight. Contrast spatial adaptation can be performed within the backlight brightness range, while spatial details corresponding to high-frequency reflected signals are reserved, and an optimal effect rendering of a high dynamic contrast image can be achieved.

BRIEF DESCRIPTION OF THE DRAWINGS

In order to more clearly illustrate the technical solution in the present invention or in the prior art, the following will illustrate the figures used for describing the embodiments or the prior art. It is obvious that the following figures are only some embodiments of the present invention. For the person of ordinary skill in the art without creative effort, it can also obtain other figures according to these figures.

DETAILED DESCRIPTION OF THE PREFERRED EMBODIMENT

The following content combines with the drawings and the embodiment for describing the present invention in detail. It is obvious that the following embodiments are embodiments of the present invention.

For the person of ordinary skill in the art without creative effort, the other embodiments obtained thereby are still covered by the present invention.

Figure 1:
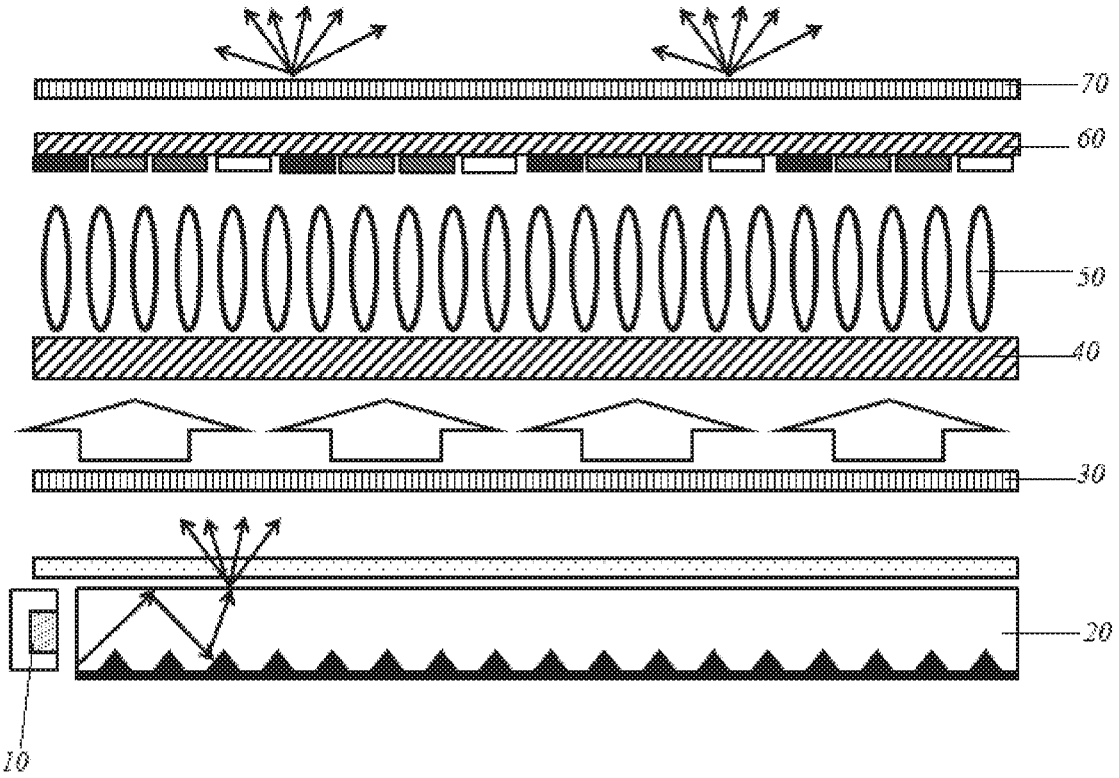
FIG. 1 (Prior art)
FIG. 1 is a schematic structural diagram of a side-light type display device according to the prior art.
Figure 2:
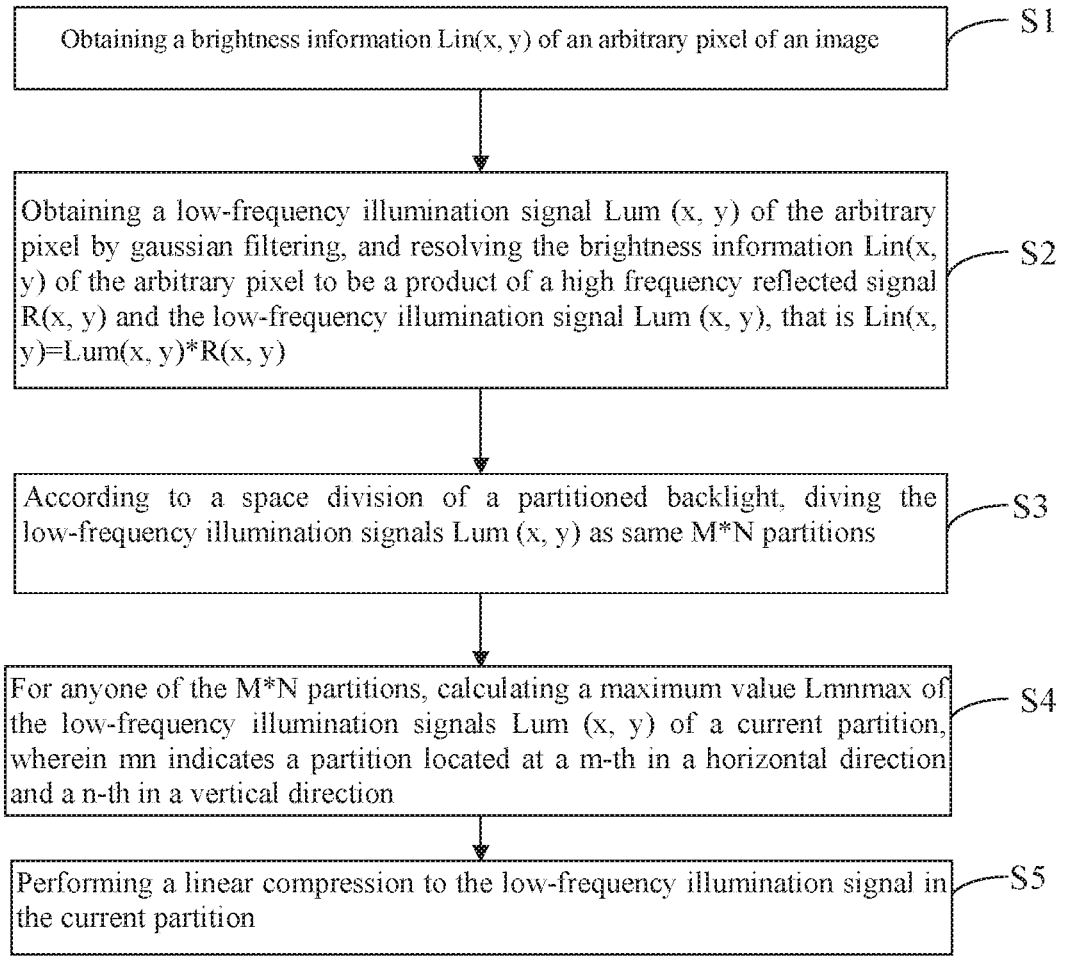
FIG. 2 is a flowchart of a high dynamic contrast image display method based on a partitioned backlight according to the present invention.

As shown in FIG. 2, the present invention discloses a high dynamic contrast image display method based on a partitioned backlight, which specifically includes:

S1: obtaining a brightness information Lin(x, y) of an arbitrary pixel of an image;

S2: obtaining a low-frequency illumination signal Lum (x, y) of the arbitrary pixel by gaussian filtering, and resolving the brightness information Lin(x, y) of the arbitrary pixel to be a product of a high frequency reflected signal R(x, y) and the low-frequency illumination signal Lum (x, y). That is Lin(x, y)=Lum(x, y)*R(x, y);

S3: according to a space division of a partitioned backlight, diving the low-frequency illumination signals Lum as same M*N partitions;

S4: for anyone of the M*N partitions, calculating a maximum value $L_{mn}$max of the low-frequency illumination signals Lum (x, y) of a current partition, wherein mn indicates a partition located at a m-th in a horizontal direction and a n-th in a vertical direction;

S5: performing a linear compression to the low-frequency illumination signal in the current partition.

Furthermore, after the step S5, the method further includes:

S6: for an arbitrary partition, calculating a luminance crosstalk among different partitions, calculating backlight brightness Blu (x, y) corresponding to pixels;

S7: calculating a brightness compensation signal $R_{new}(x, y)=Lin(x, y/Blu(x, y)$, in order to obtain a new high frequency reflected signal.

Preferably, in the step S2, "obtaining a low-frequency illumination signal Lum (x, y) of the pixel by gaussian filtering", specifically is:

$$Lum(x, y) = \sum_{i\geq -I}^{i\leq I} \sum_{j\geq -J}^{j\leq J} f(x-i, y-j) * Lin(x, y),$$

wherein f(x, y) is a two-dimensional gaussian function, I and J are preset threshold values for calculating a spatial filtering of adjacent 4*I*J pixels of a current pixel (x, y).

Preferably, in the step S5, "performing a linear compression", specifically is:

Setting a backlight brightness coefficient of a partition (m, n) as $BLU_{mn}=L_{mn}max/L_{max}*BLU_{max}$, wherein $L_{max}$ represents a maximum brightness that can be realized by the display panel, and $BLU_{max}$ represents a maximum backlight brightness among the partitions.

Wherein, the step S5 further includes:

Outputting a backlight brightness coefficient of each partition to a backlight brightness drive unit of each partition in order to light up of the backlight of each partition.

Preferably, the image in step S1 is an image of a frame of a video. An input signal of the video is a WV format. The brightness information Lin(x, y) in the step S1 is obtained through extracting an information at Y channel.

The following combines with specific embodiment for illustrating the present invention in detail.

Figure 3:
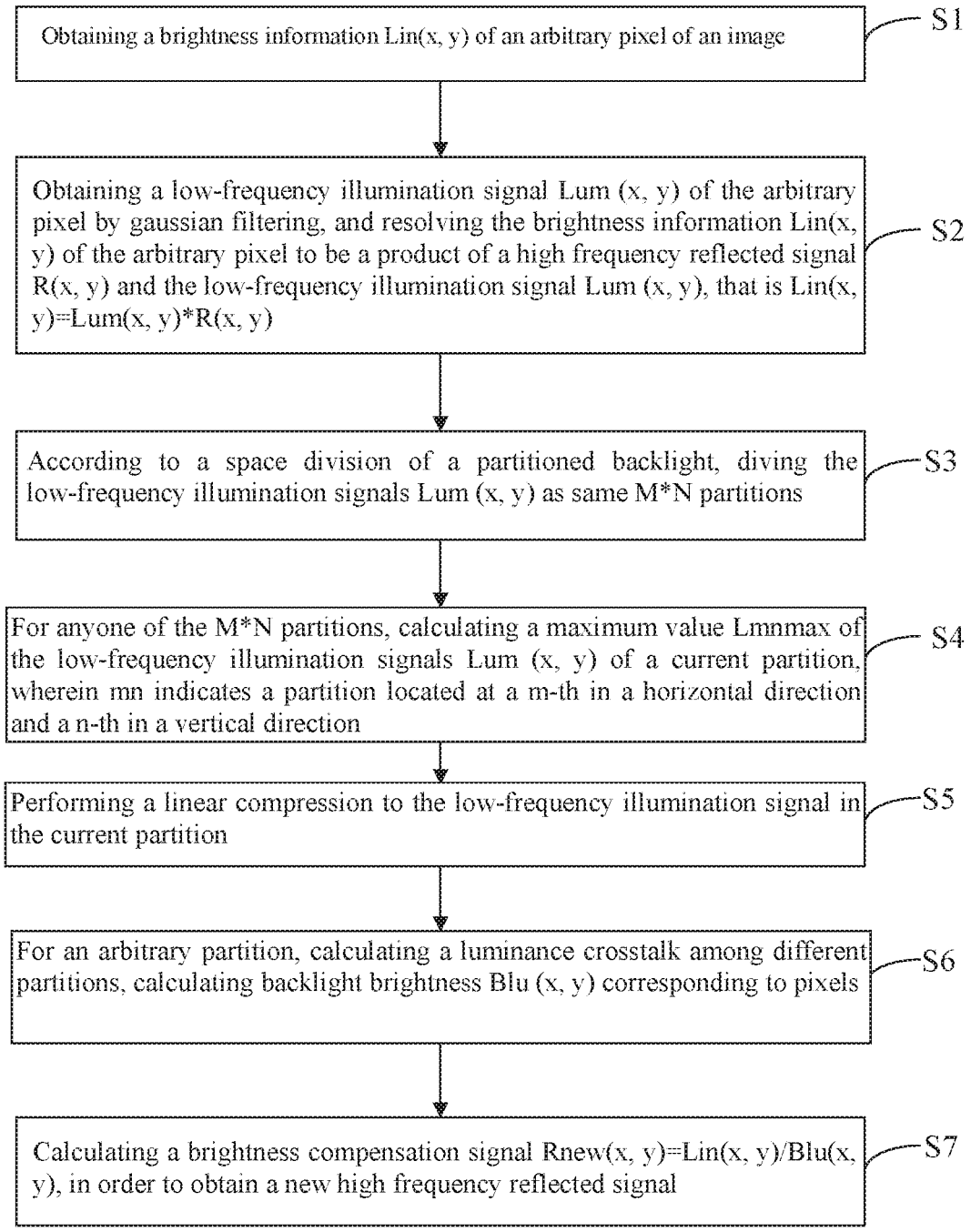
FIG. 3 is a flowchart of a high dynamic contrast image display method based on a partitioned backlight according to a specific embodiment of the present invention.

With reference to FIG. 3, in a specific embodiment of the present invention, a high dynamic contrast image display method based on a partitioned backlight specifically includes:

S1: obtaining a brightness information Lin(x, y) of an arbitrary pixel of an image, wherein (x, y) is a coordinate position of a pixel.

Wherein, the image is an image of a frame of a video. An input signal of the video is a YUV format. The brightness information Lin(x, y) in the step S1 is obtained through extracting an information at Y channel.

S2: obtaining a low-frequency illumination signal Lum (x, y) of the arbitrary pixel by a gaussian filtering, and resolving the brightness information Lin(x, y) of the arbitrary pixel to be a product of a high frequency reflected signal R(x, y) and the low-frequency illumination signal Lum (x, y). That is Lin(x, y)=Lum(x, y)*R(x, y).

The gaussian filtering specifically is:

$$Lum(x, y) = \sum_{i \geq -I}^{i \leq I} \sum_{j \geq -J}^{j \leq J} f(x-i, y-j) * Lin(x, y),$$

wherein is a two-dimensional.

gaussian function, I and J are preset threshold values for calculating a spatial filtering of adjacent 4*I*J pixels of a current pixel (x, y).

S3: according to a space division of a partitioned backlight, diving the low-frequency illumination signal Lum (x, y) as same M*N partitions, wherein M is the number of the partitions in a horizontal direction, and N is the number of the partitions in a vertical direction.

S4: for anyone of the M*N partitions, calculating a maximum value $L_{mn}$max of the low-frequency illumination signals Lum (x, y) of a current partition, wherein inn indicates a partition located at a m-th section in a horizontal direction and a n-th section in a vertical direction.

S5: performing a linear compression to the low-frequency illumination signals in the current partition.

Specifically:

Setting a backlight brightness coefficient of a partition (m, n) as $BLU_{mn}=L_{mn}max/L_{max}*BLU_{max}$, wherein $L_{max}$, represents a maximum brightness that can be realized by the display panel, and $BLU_{max}$ represents a maximum backlight brightness among the partitions.

Outputting a backlight brightness coefficient of each partition to a backlight brightness driving unit of each partition in order to light up of the backlight of each partition after obtaining the backlight brightness coefficient of each partition.

S6: for an arbitrary partition, calculating a luminance crosstalk among different partitions, calculating backlight brightness Blu (x, y) corresponding to pixels.

S7: calculating a brightness compensation signal $R_{new}$(x, y)=Lin(x, y)/Blu(x, y), in order to obtain a new high frequency reflected signal.

In step S2, the low-frequency illumination signal of the current pixel is acquired through gaussian filtering, and in step S5, the contrast compression of the low-frequency illumination signal is performed according to the actual luminance space of the display so that the adaptation can be performed according to the contrast spaces of different displays.

In addition, the calculation of the crosstalk among different partitions in step S6 needs to be adjusted according to the brightness spread of several adjacent partitions in the actual backlight. The calculation of the backlight brightness is a conventional technique in the art, no more repeating here.

The high-frequency reflected signal is re-extracted in step S7, and the high frequency local details can be maintained to a great extent. In addition, after the luminance information of the current pixel is obtained, the R/G/B three-channel output signals of different pixels can be calculated in combination with the chroma of the input signal. This calculation method is a conventional technique in the art, and will not be repeated here.

The embodiment of the invention also provides an electronic device. The electronic device includes at least one processor and a memory coupled to the at least one processor. The memory stores instructions executable by the at least one processor. When the instructions being executed by the at least one processor, the at least one processor performs the image display method in the above-described embodiment.

An embodiment of the present invention further provides a non-transitory storage medium, which stores computer-executable instructions, and the computer-executable instructions are configured to execute the foregoing image display method.

An embodiment of the present invention further provides a computer program product, the computer program product comprising a computer program stored on a non-transitory computer-readable storage medium, the computer program comprising program instructions when the program instructions are executed by a computer, the computer executes the image display method described above.

The image display apparatus provided by the embodiment of the present invention can execute the image display method provided by any embodiment of the present invention, and has the corresponding functional modules and beneficial effects of the execution method. For technical details not described in detail in the above embodiments, referring to the image display method provided by any embodiment of the present invention.

Compared with the prior art, the present invention has the following beneficial effects:

In the invention, an image to be displayed is separated into high-frequency reflected signals and low-frequency illumination signals, which respectively correspond to high-frequency liquid crystal gray-scale and low-frequency partitioned backlight signals, wherein the low-frequency illumination signals are subjected to a linear compression according to the luminance range that the actual backlight. Contrast spatial adaptation can be performed within the backlight brightness range, while spatial details corresponding to high-frequency reflected signals are reserved, and an optimal effect rendering of a high dynamic contrast image can be achieved.

Any process or method described in a flow chart or described herein in other ways may be understood to include one or more modules, segments or portions of codes of executable instructions for achieving specific logical functions or steps in the process, and the scope of a preferred embodiment of the present invention includes other implementations, not necessarily in the sequence shown or discussed here, but probably including the almost same or reverse sequence of the involved functions, which should be understood by those skilled in the art.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium include but are not limited to: an electronic connection (an electronic device) one or more wires, a portable computer enclosure magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs include one or a combination of the steps in the method embodiments of the present disclosure when run on a computer. In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks, CD, etc. Although explanatory embodiments have been shown and described, it would be appreciated by those skilled in the art that the above embodiments cannot be construed to limit the present disclosure, and changes, alternatives, and modifications can be made in the embodiments without departing from scope of the present disclosure.

For the person skilled in the art, obviously, the present invention is not limited to the detail of the above exemplary embodiment. Besides, without deviating the spirit and the basic feature of the present invention, other specific forms can also achieve the present invention. Therefore, no matter from what point of view, the embodiments should be deemed to be exemplary, not limited. The range of the present invention is limited by the claims not by the above description. Accordingly, the embodiments are used to include all variation in the range of the claims and the equivalent requirements of the claims. It should not regard any reference signs in the claims as a limitation to the claims.

Besides, it can be understood that, although the present disclosure is describe according to the embodiments, each embodiment does not include only on dependent technology solution. The description of the present disclosure is only for clarity. The person skilled in the art should regard the present disclosure as an entirety. Technology solutions in the embodiments can be adequately combined to form other embodiments that can be understood by the person skilled in the art.

What is claimed is:

1. A high dynamic contrast image display method based on a partitioned backlight, and the method comprises steps of:

S1: obtaining a brightness information Lin(x, y) of an arbitrary pixel of an image;

S2: obtaining a low-frequency illumination signal Lum (x, y) of the arbitrary pixel by gaussian filtering, and resolving the brightness information Lin(x, y) of the arbitrary pixel to be a product of a high frequency reflected signal R(x, y) and the low-frequency illumination signal Lum (x, y), that is Lin(x, y)=Lum(x, y)*R(x, y);

S3: according to a space division of a partitioned backlight, dividing the low-frequency illumination signals Lum (x, y) as identical M*N partitions, wherein M and N are positive integers;

S4: for anyone of the M*N partitions, calculating a maximum value Lmnmax of the low-frequency illumination signals Lum (x, y) of a current partition, wherein inn indicates a partition located at a m-th in a horizontal direction and a n-th in a vertical direction; and S5: performing a linear compression to the low-frequency illumination signal in the current partition.

2. The high dynamic contrast image display method based on a partitioned backlight according to claim 1, wherein the step S2, "obtaining a low-frequency illumination signal Lum (x, y) of the pixel by gaussian filtering", is:

$$Lum(x, y) = \sum_{i \geq -I}^{i \leq I} \sum_{j \geq -J}^{j \leq J} f(x-i, y-j) * Lin(x, y),$$

wherein f(x, y) is a two-dimensional gaussian function, I and J are preset threshold values for calculating a spatial filtering of adjacent 4*I*J pixels of a current pixel (x, y).

3. The high dynamic contrast image display method based on a partitioned backlight according to claim 1, wherein the step S5, "performing a linear compression", is:

setting a backlight brightness coefficient of a partition (in, n) as $BLU_{mn}=L_{mn}max/L_{max}*BLU_{max}$, wherein $L_{max}$ represents a maximum brightness that can be realized by the display panel, and $BLU_{max}$ represents a maximum backlight brightness among the partitions.

4. The high dynamic contrast image display method based on a partitioned backlight according to claim 3, wherein the method further comprises a step of:

outputting a backlight brightness coefficient of each partition to a backlight brightness driving unit of each partition in order to light up the backlight of each partition.

5. The high dynamic contrast image display method based on a partitioned backlight according to claim 3, wherein after the step S5, the method further comprises a step of:

S6: for an arbitrary partition, calculating a luminance crosstalk among different partitions, calculating backlight brightness Blu (x, y) corresponding to pixels; and S7: calculating a brightness compensation signal $R_{new}$(x, y)=Lin(x, y)/Blu(x, y), in order to obtain a new high frequency reflected signal.

6. The high dynamic contrast image display method based on a partitioned backlight according to claim 1, wherein the image in the step S1 is an image of a frame of a video, and an input signal of the video is a YUV format.

7. The high dynamic contrast image display method based on a partitioned backlight according to claim 6, wherein the brightness information Lin(x, y) in the step S1 is obtained through extracting an information at Y channel.

8. A high dynamic contrast image display device based on a partitioned backlight, the high dynamic contrast image display device includes multiple backlight units and backlight brightness driving units which are correspondingly one by one, the high dynamic contrast image display device displays an image through a high dynamic contrast image display method based on a partitioned backlight, and the method comprises steps of:

obtaining a brightness information Lin(x, y) of an arbitrary pixel of an image;

obtaining a low-frequency illumination signal Lum (x, y) of the arbitrary pixel by gaussian filtering, and resolving the brightness information Lin(x, y) of the arbitrary pixel to be a product of a high frequency reflected signal R(x, y) and the low-frequency illumination signal Lum (x, y), that is Lin(x, y)=Lum(x, y)*R(x, y);

according to a space division of a partitioned backlight, dividing the low-frequency illumination signals Lum (x, y) as identical M*N partitions, wherein M and N are positive integers;

for anyone of the M*N partitions, calculating a maximum value Lmnmax of the low-frequency illumination signals Lum (x, y) of a current partition, wherein inn indicates a partition located at a m-th in a horizontal direction and a n-th in a vertical direction; and performing a linear compression to the low-frequency illumination signal in the current partition.

9. The high dynamic contrast image display device based on a partitioned backlight according to claim 8, wherein the step of obtaining a low-frequency illumination signal Lum (x, y) of the pixel by gaussian filtering is:

$$Lum(x, y) = \sum_{i \geq -I}^{i \leq I} \sum_{j \geq -J}^{j \leq J} f(x-i, y-j) * Lin(x, y),$$

wherein f(x, y) is a two-dimensional gaussian function, I and J are preset threshold values for calculating a spatial filtering of adjacent 4*I*J pixels of a current pixel (x, y).

10. The high dynamic contrast image display device based on a partitioned backlight according to claim 8, wherein the step of performing a linear compression is:

setting a backlight brightness coefficient of a partition (m, n) as $BLU_{mn}=L_{mn}max/L_{max}*BLU_{max}$, wherein Lmax represents a maximum brightness that can be realized by the display panel, and $BLU_{max}$ represents a maximum backlight brightness among the partitions.

11. The high dynamic contrast image display device based on a partitioned backlight according to claim 10, wherein the step of performing a linear compression further comprises:

outputting a backlight brightness coefficient of each partition to the backlight brightness driving unit of each partition in order to light up the backlight of each partition.

12. The high dynamic contrast image display device based on a partitioned backlight according to claim 10, wherein the method further comprises a step of:

for an arbitrary partition, calculating a luminance crosstalk among different partitions, calculating backlight brightness Blu (x, y) corresponding to pixels; and calculating a brightness compensation signal $R_{new}$(x, y)=Lin(x, y)/Blu(x, y), in order to obtain a new high frequency reflected signal.

13. The high dynamic contrast image display device based on a partitioned backlight according to claim 8, wherein the image is an image of a frame of a video, and an input signal of the video is a YUV format.

14. The high dynamic contrast image display device based on a partitioned backlight according to claim 13, wherein the brightness information Lin(x, y) in obtaining a brightness information Lin(x, y) is obtained through extracting an information at Y channel.

* * * * *